US007749114B2

(12) United States Patent
Thouin

(10) Patent No.: US 7,749,114 B2
(45) Date of Patent: Jul. 6, 2010

(54) COMPOSITE BAT

(75) Inventor: Maxime Thouin, San Diego, CA (US)

(73) Assignee: True Temper Sports, Inc., Memphis, TN (US)

( * ) Notice: Subject to any disclaimer, the term of this patent is extended or adjusted under 35 U.S.C. 154(b) by 0 days.

(21) Appl. No.: 12/107,352

(22) Filed: Apr. 22, 2008

(65) Prior Publication Data

US 2009/0264230 A1 Oct. 22, 2009

(51) Int. Cl.
*A63B 59/06* (2006.01)

(52) U.S. Cl. ..... 473/520; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 3,877,698 | A * | 4/1975 | Volpe | 473/520 |
| 4,951,948 | A * | 8/1990 | Peng | 473/520 |
| 5,180,163 | A | 1/1993 | Lanctot et al. | |
| 5,219,164 | A * | 6/1993 | Peng | 473/520 |
| 5,593,158 | A * | 1/1997 | Filice et al. | 473/520 |
| 6,159,116 | A | 12/2000 | Pitsenberger | |
| 6,398,675 | B1 * | 6/2002 | Eggiman et al. | 473/566 |
| 6,440,017 | B1 * | 8/2002 | Anderson | 473/566 |
| 6,461,260 | B1 | 10/2002 | Higginbotham | |
| 6,663,517 | B2 * | 12/2003 | Buiatti et al. | 473/566 |
| 6,761,653 | B1 | 7/2004 | Higginbotham et al. | |
| 6,808,464 | B1 * | 10/2004 | Nguyen | 473/566 |
| 6,866,598 | B2 | 3/2005 | Giannetti et al. | |
| 6,872,156 | B2 * | 3/2005 | Ogawa et al. | 473/567 |
| 7,044,871 | B2 * | 5/2006 | Sutherland et al. | 473/564 |
| 7,128,670 | B2 * | 10/2006 | Souders et al. | 473/567 |
| 7,201,679 | B2 * | 4/2007 | Nguyen | 473/520 |
| 2004/0127310 | A1 | 7/2004 | Hsu | |
| 2004/0132564 | A1 | 7/2004 | Giannetti et al. | |
| 2004/0176197 | A1 | 9/2004 | Sutherland | |

(Continued)

OTHER PUBLICATIONS

Russell, Daniel A.; Acoustics of Baseball Bats. Science & Mathematics Department, Kettering University, Flint, MI 48504-4898; © 2000-2003 [online], [retrieved on Apr. 3, 2008]. Retrieved from the Internet:< URL: http://www.kettering.edu/~drussell/bats-new-bend-sweet.html.

(Continued)

*Primary Examiner*—Mark S Graham
(74) *Attorney, Agent, or Firm*—Harness, Dickey & Pierce, P.L.C.

(57) ABSTRACT

A bat has a barrel with a multi-wall construction. The handle can be formed integrally with the inner wall. A damping device can be installed between the handle and the outer wall of the barrel. The damping device can dampen vibrations transmitted from the outer wall to the handle. The damping device can also separate the outer wall from the inner wall adjacent the handle section. The inner and outer walls can be bonded together adjacent the end of the bat. Alternatively, the inner and outer walls can be entirely free of bonding to one another. Additionally, a damping device can separate the outer wall from the inner wall adjacent the end of the bat. Furthermore, the bat can include a pair of damping devices that separate the inner wall from the outer wall both adjacent the handle section and at the end of the bat.

4 Claims, 7 Drawing Sheets

U.S. PATENT DOCUMENTS

| | | | | |
|---|---|---|---|---|
| 2004/0209716 | A1 | 10/2004 | Vacek et al. | |
| 2005/0227795 | A1 | 10/2005 | Fritzke | |
| 2006/0025249 | A1 | 2/2006 | Giannetti et al. | |
| 2006/0025250 | A1 | 2/2006 | Giannetti | |
| 2006/0025253 | A1 | 2/2006 | Giannetti et al. | |
| 2007/0155546 | A1* | 7/2007 | Chauvin et al. | 473/520 |
| 2007/0202973 | A1* | 8/2007 | Van Nguyen | 473/564 |
| 2008/0070726 | A1* | 3/2008 | Watari et al. | 473/566 |
| 2008/0161140 | A1* | 7/2008 | Misono et al. | 473/568 |

OTHER PUBLICATIONS

Russell, Ph.D., Daniel A.; Physics and Acoustics of Baseball & Softball Bats. Science & Mathematics Department, Kettering University, Flint, MI 48504-4898; © 2003-2004 [online], [retrieved on Apr. 3, 2008]. Retrieved from the Internet:<URL: http://www.kettering.edu/~drussell/bats-new/modal.html.

Russell, Daniel A.; Physicis and Acoustics of Baseball & Softball Bats. Applied Physics, Kettering University, Flint, MI 48504-4898; © 2003 [online], [retrieved on Apr. 3, 2008]. Retrieved from the Internet:< URL: http://www.kettering.edu/~drussell/bats-new/batvibes.html.

* cited by examiner

COMPOSITE BAT

FIELD

The present teachings relate to composite bats and, more particularly, to multi-wall composite bats.

BACKGROUND

The statements in this section merely provide background information related to the present teaching and may not constitute prior art.

Baseball and softball bats can be made from composite materials. These bats typically include a handle, a barrel, and a tapered section joining the handle to the barrel. The bats can include a hollow interior, thereby forming bats that are relatively lightweight. The barrel can be of a multi-wall construction. In a multi-wall construction, there is an inner barrel surrounded by one or more outer barrels. Each barrel can act as a tubular spring, or similar structure. Each of the barrels can have the same or different composition. In the multi-wall construction, the barrels can be at least partially separated from one another, thereby allowing the barrels to slide or move relative to one another during an impact with a ball. The ability to slip or move relative to one another separates the bending of the barrels from one another and can distribute the stress between the various walls while allowing greater-force transfer to the ball being hit with the bat.

The inner and outer barrels can be laminated, cross-linked, or otherwise bonded together (hereinafter referred to collectively as "bonded") at the end of the bat and also adjacent the tapering section of the bat. The handle can be bonded with either the inner or outer barrels. The bonding together of the inner and outer barrels at both the tip and adjacent the tapering section can increase the vibration in both the inner and outer barrels and transmit the vibrations therebetween. Additionally, the coupling of the handle to either the inner or outer barrels can also transmit vibration through the handle. The vibration transfer can be an undesirable characteristic to a user of the bat. Thus, it would be advantageous to reduce the vibrations that travel to the handle of the bat when striking a ball. Isolating the handle from the barrel, however, can reduce the feel of the bat to the user. In particular, while it is desirable to reduce the vibrations experienced by the user, some tactile sensation of striking the ball with the bat can be desirable and provide a pleasing feel upon contacting the ball. Additionally, a solid connection between the handle and the barrel can enable the bat to have better performance as opposed to a multi-piece construction wherein the barrel and handle are bonded together which results in energy loss during use of the bat.

Thus, it would be advantageous to reduce the vibrations transmitted to the handle while still providing a tactile sensation for a user of the bat when contacting a ball. Furthermore, it would be advantageous if such construction can utilize a multi-wall barrel, thereby improving the energy transfer to the ball.

SUMMARY

A bat according to the present teachings has a barrel with a multi-wall construction. The handle can be formed integrally with the inner wall. A damping device can be installed between the handle and the outer wall of the barrel. The damping device can dampen vibrations transmitted from the outer wall to the handle. The damping device can also separate the outer wall from the inner wall adjacent the handle section. The inner and outer walls can be bonded together adjacent the end of the bat. Alternatively, the inner and outer walls can be entirely free of bonding to one another. Additionally, a damping device can separate the outer wall from the inner wall adjacent the end of the bat. Furthermore, the bat can include a pair of damping devices that separate the inner wall from the outer wall both adjacent the handle section and at the end of the bat.

A bat according to the present teachings includes a handle portion adjacent a first end, a barrel portion adjacent a second end, and at least one damping member. The barrel portion can be a multi-wall construction and can include an inner wall and an outer wall that radially surrounds the inner wall. The damping member can be disposed between the inner wall and the outer wall.

A bat according to the present teachings can include a handle portion adjacent a first end and a barrel portion adjacent a second end. The barrel portion can be a multi-wall construction and can include an inner wall radially surrounded by an outer wall. A tapering portion can connect the handle portion to the barrel portion. There can also be a damping member that dampens vibration between the barrel portion and the handle portion. The inner wall can extend from the first end to the second end and can form the handle portion, the tapering portion, and the barrel portion. The damping member can be disposed on the inner wall. The outer wall can extend from the second end toward the first end and can terminate on the damping member with the damping member separating the inner wall from a portion of the outer wall on the damping member.

A method of forming a multi-wall composite bat having a damping member, a handle end, and a barrel end can include forming an inner wall with a plurality of plies of composite material and positioning a damping member on the inner wall. An outer wall can be formed with a plurality of plies of composite material so that the outer wall radially surrounds a portion of the inner wall and forms a barrel section of the bat with the damping member separating at least a portion of the outer wall from a portion of the inner wall. The inner and outer walls can be cured in a mold, thereby forming the bat.

Further areas of applicability will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

DETAILED DESCRIPTION

Figure 1:
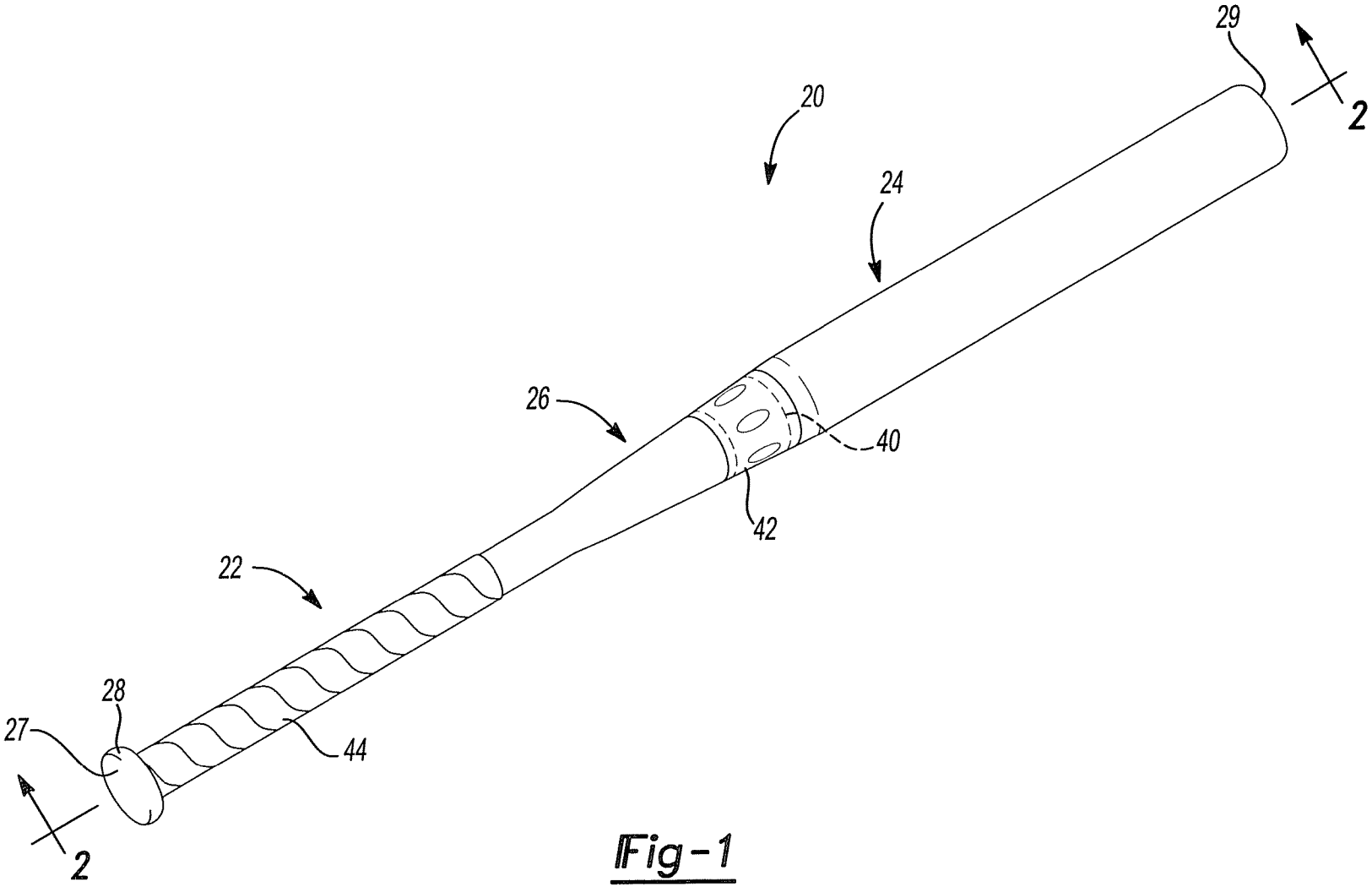
FIG. 1 is a perspective view of a first embodiment of a bat according to the present teachings.

The following description is merely exemplary in nature and is not intended to limit the present teachings, applications, or uses. It should be understood that throughout the drawings, corresponding reference numerals indicate like or corresponding parts and features (e.g., 20, 120, 220, etc.)

Figure 2:
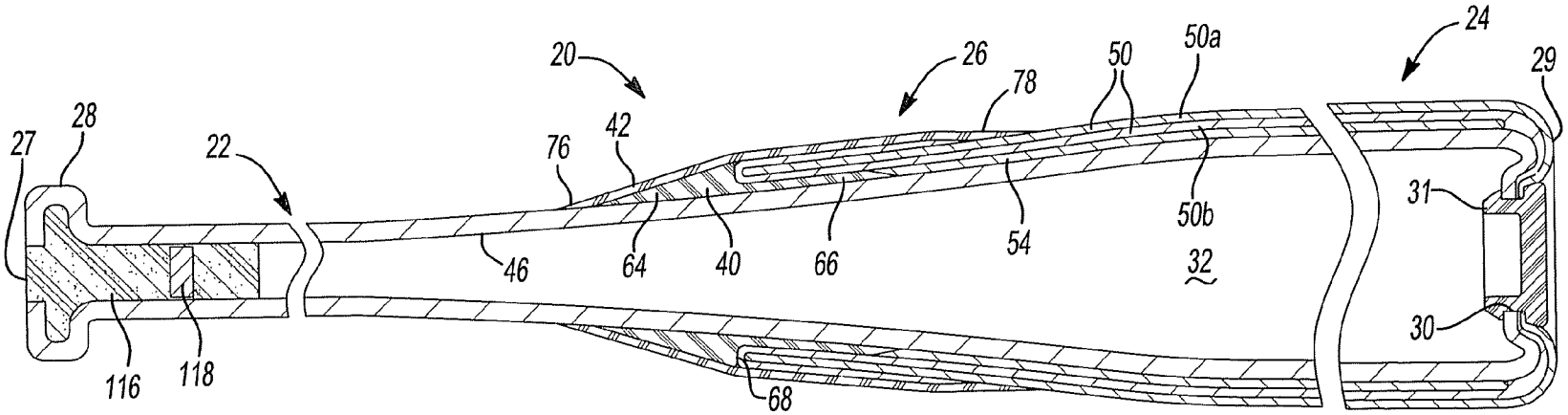
FIG. 2 is a cross-sectional view along lines 2-2 of FIG. 1.

A baseball or softball bat 20 according to a first embodiment of the present teachings is shown in FIGS. 1 and 2. Bat 20 includes a handle portion 22, a barrel portion 24, and a tapering portion 26 extending between handle portion 22 and barrel portion 24. Handle portion 22 has a free end 27 at which a knob 28 or similar structure is located. The end 29 of barrel portion 24 is closed off by a suitable cap or plug 30. Bat 20 can include an interior cavity 32. With interior cavity 32, bat 20 is at least partially hollow, which allows barrel portion 24 of bat 20 to be relatively lightweight so that increased bat speed can be achieved by a user.

Bat 20 includes a damping member 40 that in some embodiments can be disposed on tapering portion 26. In other embodiments, damping member 40 can be disposed on handle portion 22, barrel portion 24, or at a transition location between handle portion 22, tapering portion 26, and/or barrel portion 24. Damping member 40 can serve to isolate the inner and outer walls of barrel portion 24, as described below. A finishing ring member 42 can be disposed over damping member 40 and provide a finished appearance for bat 20. A gripping member 44 can be disposed on handle portion 22.

Referring now to FIG. 2, bat 20 is a multi-wall construction and includes an inner wall 46 and an outer wall 50. Inner wall 46 is integral with and forms handle portion 22, tapering portion 26, and barrel portion 24. In some embodiments, outer wall 50 forms barrel portion 24 and part of tapering portion 26 in conjunction with inner wall 46. In other embodiments, outer wall 50 can be limited to forming only part of barrel portion 24. In other embodiments, outer wall 50 can form a limited part of handle portion 22 adjacent tapering portion 26 along with barrel portion 24. The extent to which outer wall 50 forms part of handle portion 22, tapering portion 26, and/or barrel portion 24 can be limited by the location of damping member 40 on inner wall 46. Outer wall 50 radially surrounds inner wall 46. A bond-inhibiting interface 54 can prevent inner wall 46 from bonding with outer wall 50 wherever bond-inhibiting interface 54 is located. Bond-inhibiting interface 54 thereby allows relative movement between inner and outer walls 46, 50 at locations where bond-inhibiting interface 54 is disposed.

Inner wall 46 is comprised of one or more plies of composite material which can form one or more layers, as described below. Additionally, outer wall 50 also comprises one or more plies of composite material which can form one or more layers, as described below. Additionally, bond-inhibiting interface 54 can comprise one or more plies of material that prevents bonding between inner and outer walls 46, 50 during the molding process. The bond-inhibiting interface 54 can extend between inner wall 46 and outer wall 50 along a substantial portion of outer wall 50. For example, as shown in FIG. 2, bond-inhibiting interface 54 can extend from damping member 40 along inner wall 46 and stop short of end 29 of bat 20. Beyond bond-inhibiting interface 54 adjacent end 29, inner and outer walls 46, 50 can contact one another and form an integral bond therebetween during the molding process. In some embodiments, bond-inhibiting interface 54 can extend all the way to the end of outer wall 50, as described below.

Figure 3:
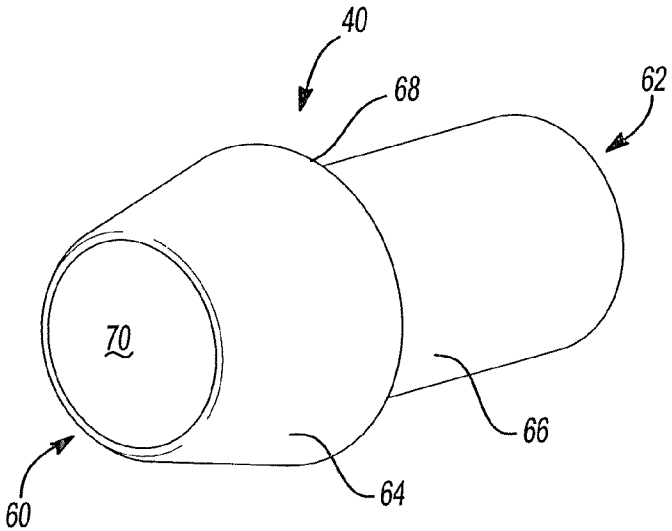
FIG. 3 is a perspective view of the damping member according to the present teachings.

Referring now to FIGS. 1-3, damping member 40 has opposite first and second ends 60, 62 with a conical or tapering section 64 and a generally cylindrical section 66 therebetween. Tapering section 64 has a radial dimension that reduces toward first end 60 and has a shoulder 68 adjacent cylindrical section 66. First and second ends 60, 62 are open with a generally cylindrical cavity 70 therebetween. Cavity 70 allows damping member 40 to be inserted onto bat 20 during the construction process, as described below. Damping member 40 is flexible and is operable to dampen vibrations in bat 20. Damping member 40 can be made from a variety of materials. By way of non-limiting examples, damping member 40 can be urethane, thermoplastic, a solid rubber, and the like. Additionally, damping member 40 can have a hardness of between about 20 to about 100 on the Shore 00 scale, by way of non-limiting example. Damping member 40 preferably does not bond or cross-link with inner or outer walls 46, 50 during the molding process.

Figure 4:
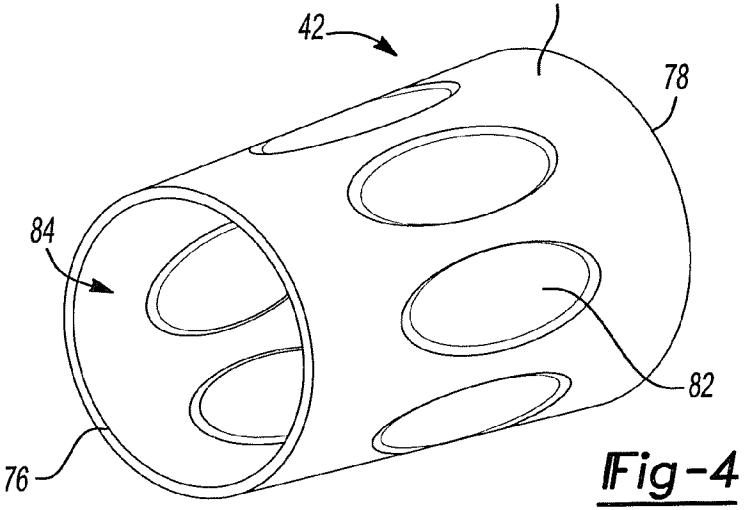
FIG. 4 is a perspective view of the ring member.
Figure 5:
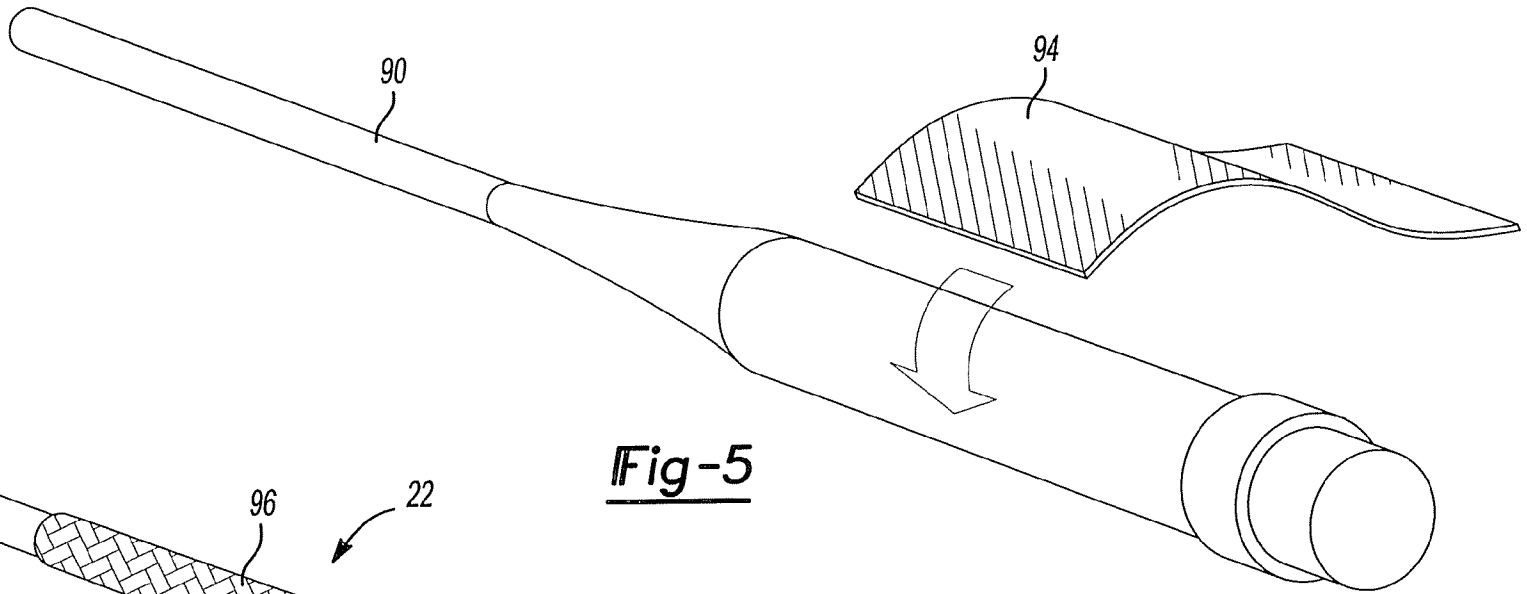
FIGS. 5-8 are perspective views of the manufacturing of the bat of FIG. 1.

Referring now to FIGS. 1, 2, and 4, ring member 42 includes opposite first and second ends 76, 78 and a tapering wall 80 extending therebetween. A plurality of openings 82 can be disposed in wall 80. Openings 82 can allow a user of bat 20 to visually see damping member 40. Ring member 42 has a cavity 84 extending between first and second ends 76, 78 and allows ring member 42 to be inserted onto bat 20 and conceal a majority of damping member 40. Ring member 42 is attached to bat 20 after the molding process. Ring member 42 is flexible and can be made of a variety of materials. By way of non-limiting example, ring member 42 can be rubber, urethane, thermoplastic, and the like.

As stated above, inner and outer walls 46, 50 can each be constructed with one or more plies of composite material. The composite material, by way of non-limiting example, can be fiber-reinforced and may include glass, boron, carbon (graphite), aramid, ceramic, and/or any other suitable reinforcement material. The various plies can be pre-impregnated with a laminating adhesive to bond the various plies together during the molding process, as known in the art. The plies can take a variety of forms. By way of non-limiting example, the plies can be a unidirectional material-tape, woven fabrics, braided fabrics, randomly oriented fibers, and the like.

Referring now to FIGS. 5-10, construction of bat 20 according to the present teachings will be shown. A mandrel 90 is used to form bat 20. Mandrel 90 is generally shaped in the configuration desired for the interior cavity 32 of bat 20. Inner and outer walls 46, 50 are formed by wrapping multiple plies 94 of composite material on mandrel 90. The plies 94 are wrapped on mandrel 90 in various orientations to provide a desired construction for bat 20, as known in the art.

Initially, inner wall 46 is formed on mandrel 90 by wrapping multiple plies 94 of composite material over the surface of mandrel 90. The initial plies 94 can include a tissue or other backing that prevents the initial plies 94 from sticking to mandrel 90. Successive plies 94 are wrapped along mandrel 90 from the handle section through the barrel section with the plies overlapping one another. The plies 94 can be pre-impregnated and contain the adhesive therein.

Figure 6:
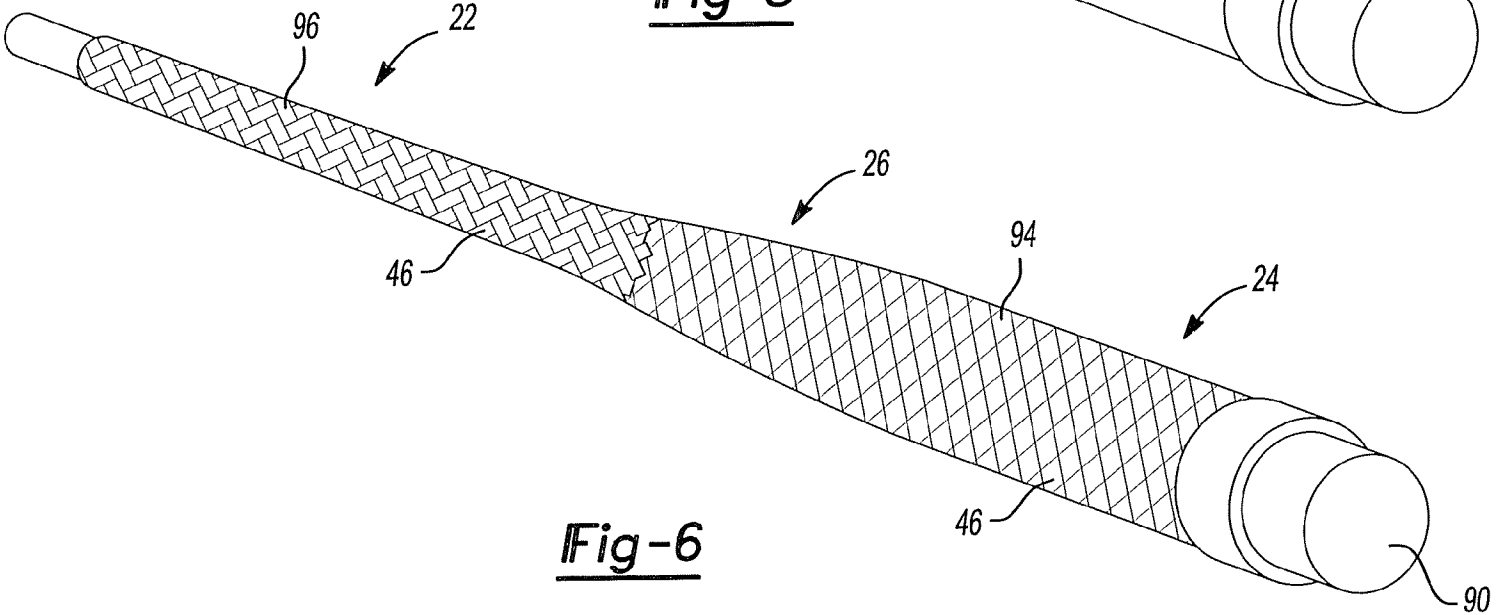
Figure 7:
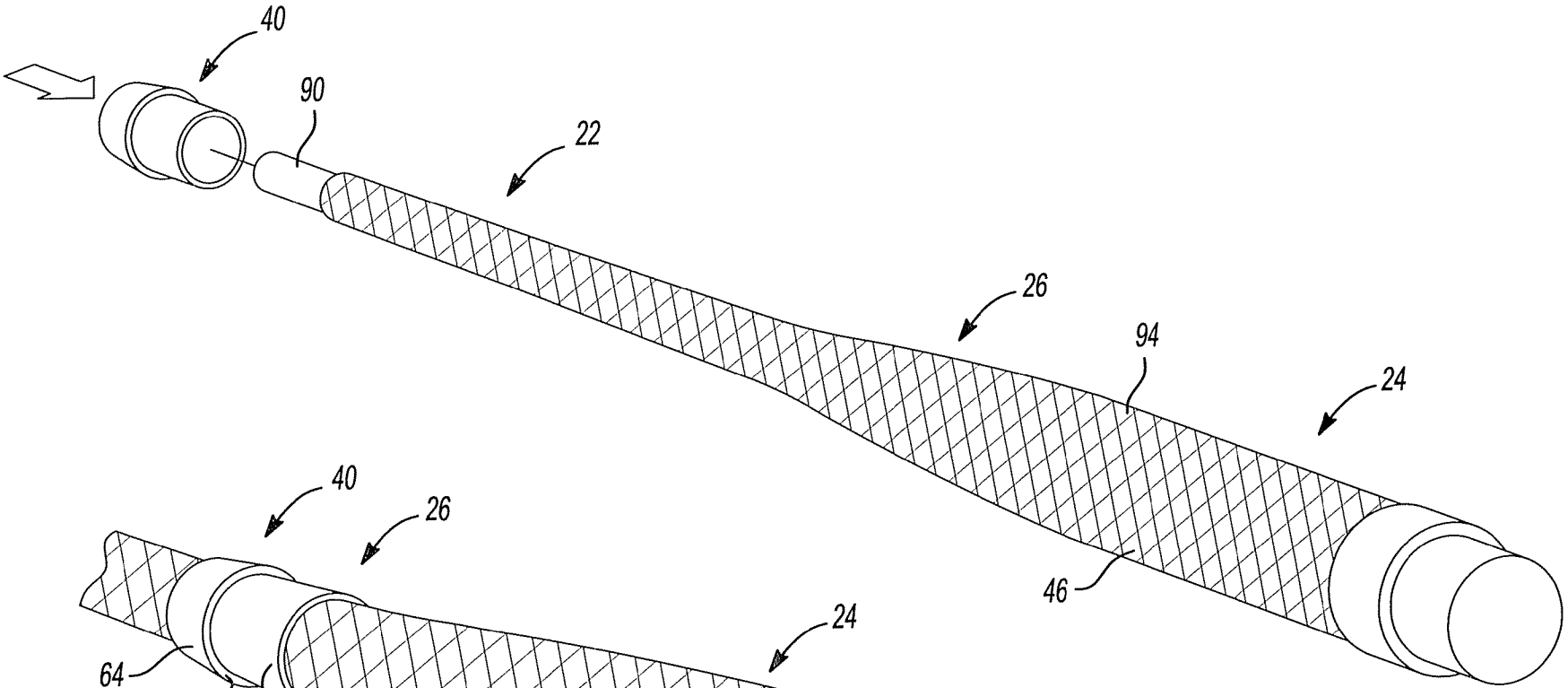
Figure 8:
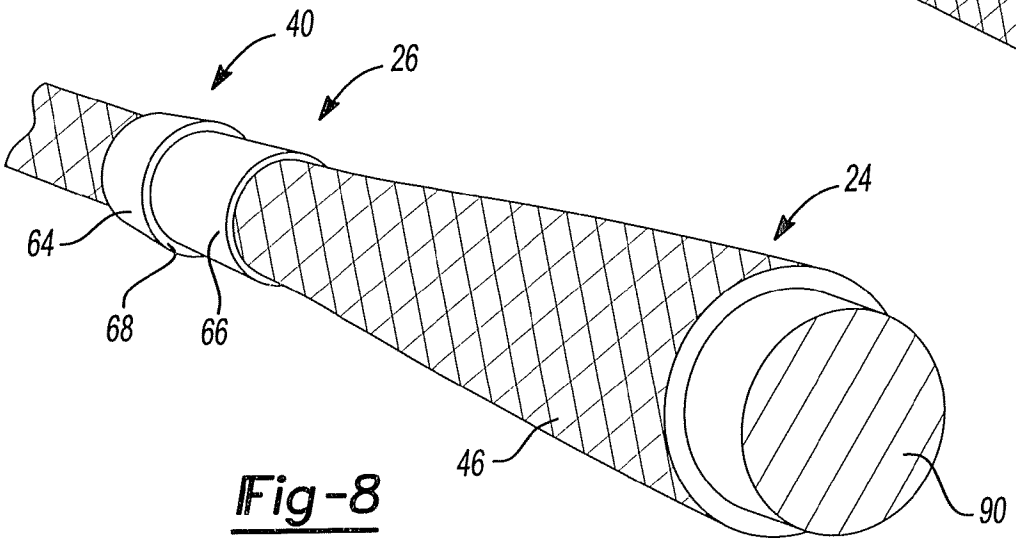

After inner wall 46 has been formed to a predetermined level, a braided fabric tube 96 is slid over the handle side of mandrel 90 and positioned on bat 20, as shown in FIG. 6. Braided fabric tube 96 can be dry (not pre-impregnated). Braided fabric tube 96 will form an integral part of handle portion 22. After securing braided fabric tube 96 in place, the inner wall 46 continues to be built up using additional plies 94 that are wrapped over braided fabric tube 96 and the rest of inner wall 46. Plies 94 continue to be applied to mandrel 90 until the entire inner wall 46 has been constructed, as shown in FIG. 7.

With the construction of inner wall 46 complete, damping member 40 can be positioned on mandrel 90 from the handle end. Damping member 40 is positioned on inner wall 26 at a desired location, such as the location shown in FIG. 8.

Once damping member 40 is in its desired location, bond-inhibiting interface 54 is formed on bat 20. Bond-inhibiting interface 54 can be disposed on bat 20 between damping member 40 and end 29. Bond-inhibiting interface 54 prevents the adhesives in inner and outer walls 46, 50 from bonding with one another, as known in the art. Bond-inhibiting interface 54 can be formed by one or more plies of materials that do not cross-link or adhere to the adhesive used in the inner and outer walls 46, 50. By way of non-limiting example, bond inhibiting interface 54 can be formed from one or more plies of polypropylene or other thermoplastic films. The bond-inhibiting interface 54 can stop short of end 29, thereby allowing inner and outer walls 46, 50 to bond together at end 29.

Figure 9:
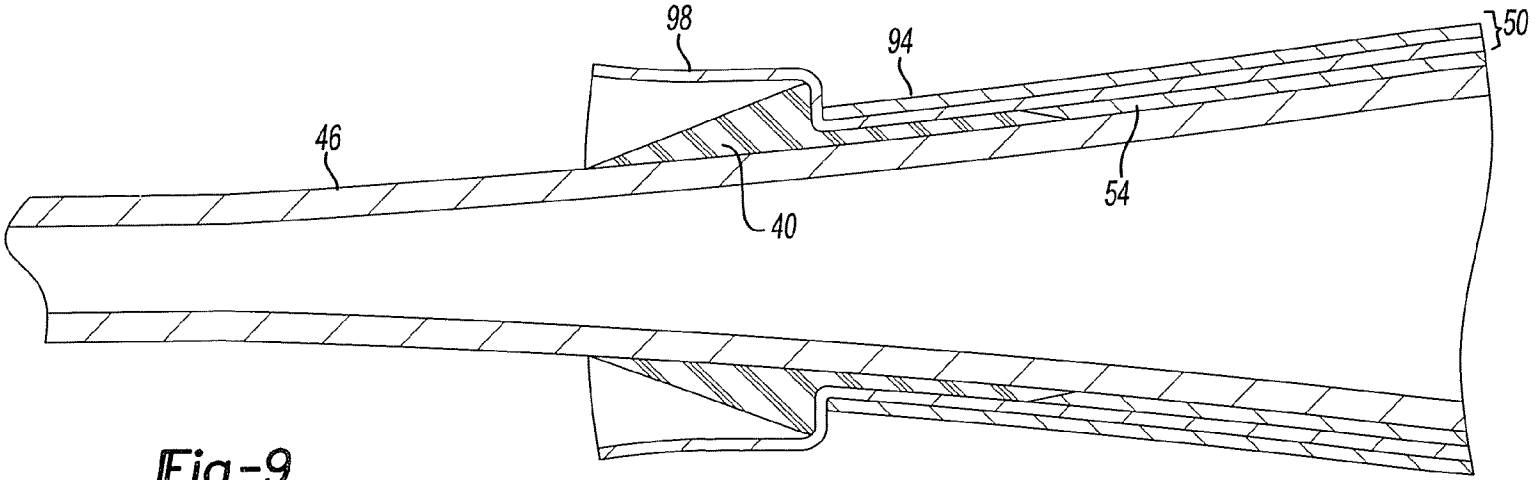
FIGS. 9 and 10 are fragmented cross-sectional views similar to that of FIG. 2 illustrating some of the manufacturing steps of the bat.

Next, outer wall 50 is formed by applying one or more plies 94 over top of inner wall 46 from damping member 40 to end 29. The plies 94, as shown in FIG. 9, can extend over top of cylindrical section 66 of damping member 40. Outer wall 50 is built up by applying the plies 94 in differing locations and in differing orientations to provide a desired construction for outer wall 50.

Figure 10:
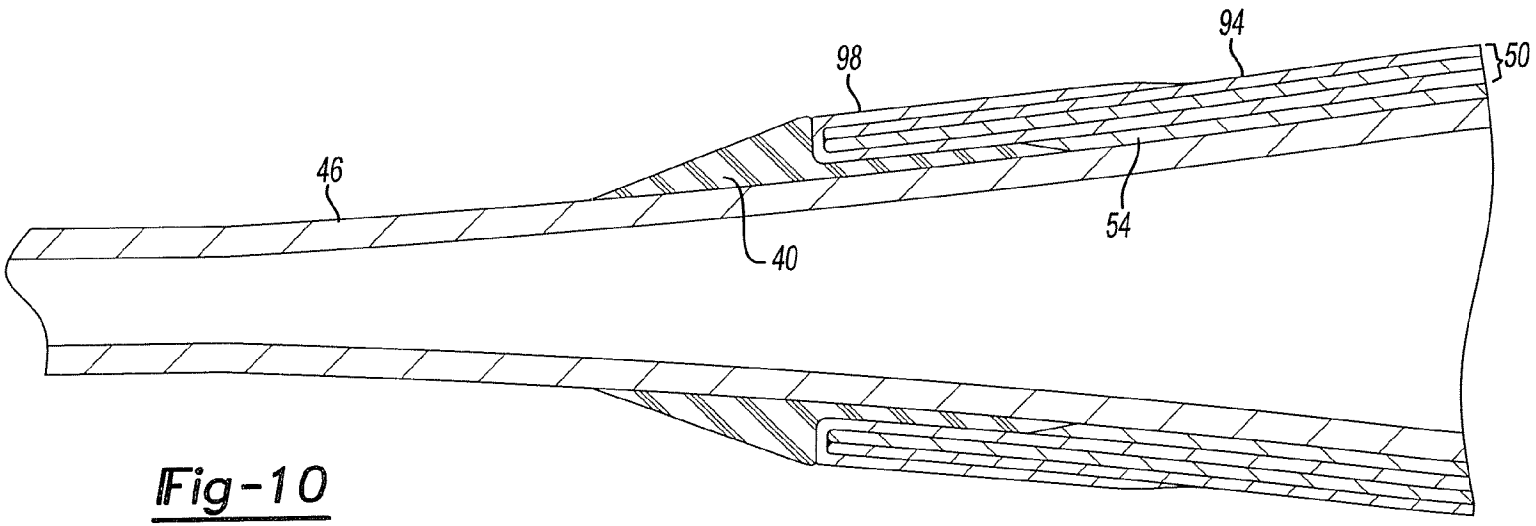
Figure 11:
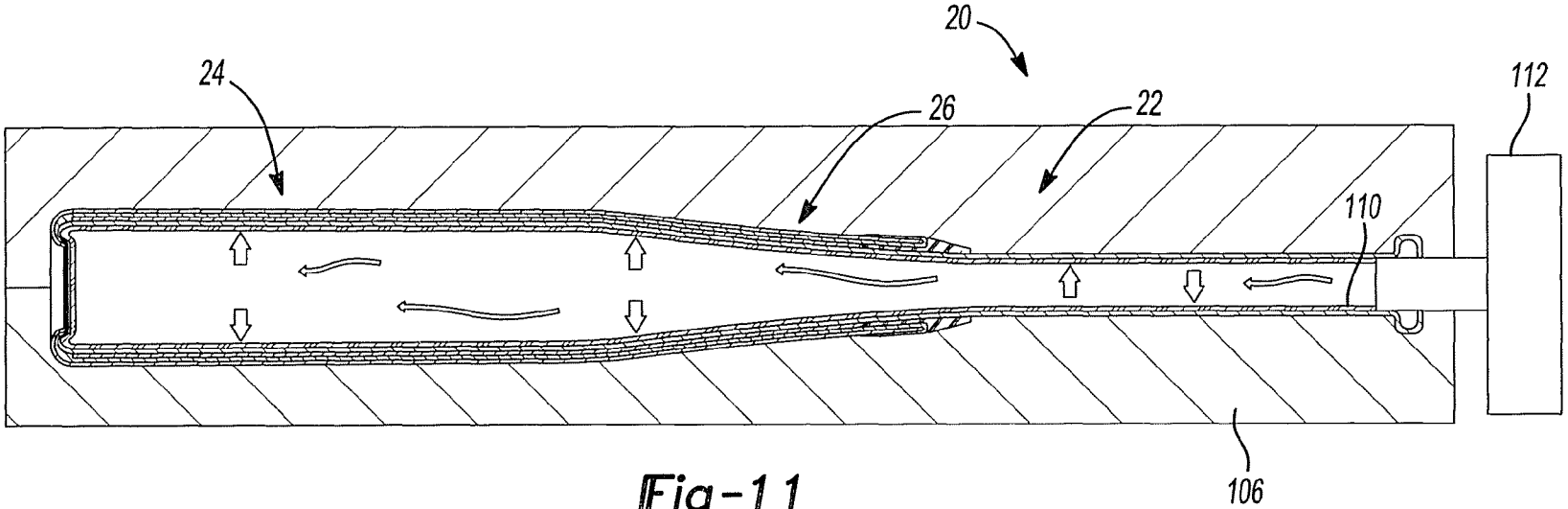
FIG. 11 is a cross-sectional representation of the molding of the bat according to the present teachings.
Figure 14:
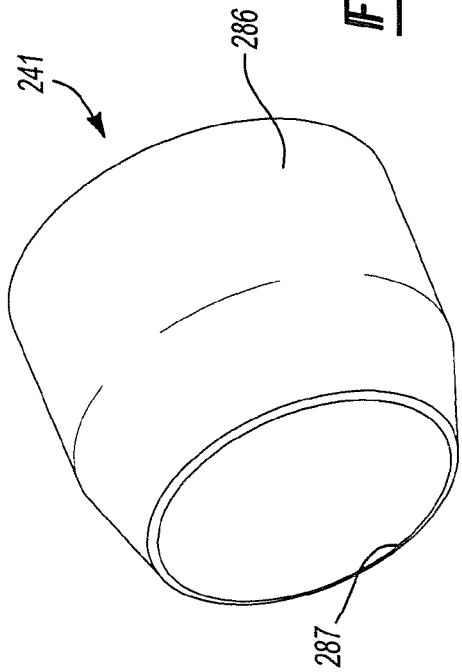
FIG. 14 is a perspective view of the damping member used at the end of the bat depicted in FIG. 13.

At some point during construction of bat 20, one or more of the plies 94 that form outer wall 50 are wrapped around cylindrical section 66 and extend from at least cylindrical section 66 over top of shoulder 68 and tapering section 64, thereby forming a flap 98, as shown in FIG. 9. Additional plies 94 are applied on top of the existing construction of outer wall 50 to form the desired thickness of outer wall 50. These additional plies can extend over the portion of flap 98 that is between tapering section 64 and end 29 of bat 20. Once outer wall 50 has been formed to the desired construction, flap 98 can be folded forwardly over top of the existing plies that form outer wall 50, as shown in FIG. 10. This construction allows flap 98 to sandwich the ends of plies 94 that are adjacent shoulder 68 together and form a finished construction.

Once outer wall 50 has been formed, mandrel 90 is removed from bat 20 and bat 20 is positioned within a mold 106. The end 29 of bat 20 can be formed by pushing the various plies that form inner and outer walls 46, 50 into the interior cavity 32 of bat 20. An air bladder 110 is positioned within interior cavity 32 and communicates with an air source 112 which is exterior to mold 106. Within mold 106, air bladder 110 is filled with air from air source 112 to pressurize interior cavity 32 and force bat 20 radially outwardly against the mold 106. Additionally, mold 106 can be heated to facilitate the bonding and curing of the adhesives in the various plies used to form inner and outer walls 46, 50. The molding process is well-known in the art and, as such, will not be described further.

After molding bat 20 in mold 106, bat 20 is removed therefrom. The handle portion 22 can have foam 116 inserted therein along with one or more weights 118. Foam 116 seals interior cavity 32 at end 27 while weights 118 can provide a desired weighting for bat 20.

End 29 is formed by cutting or trimming the ends of the various plies that form inner and outer walls 46, 50 adjacent end 29. Once trimmed, cap 30 is pressed into end 29 and pawls 31 secure cap 30 thereto. Bat 20 can be sealed and painted to provide a desired exterior appearance for bat 20. Ring member 42 can also be inserted over bat 20 and positioned on top of damping member 40. In some embodiments, the molding of bat 20 can leave depressions around damping member 40 that facilitate the positioning and retention of ring member 42 on bat 20.

In the final construction of bat 20, as shown in FIG. 2, cylindrical section 66 of damping member 40 separates inner wall 46 from outer wall 50 at tapering portion 26. This separation dampens vibration in outer wall 50 from traveling to inner wall 46 and handle portion 22 through tapering portion 26. Additionally, damping member 40 also serves to dampen vibrations within inner wall 46 and can inhibit the traveling of vibrations from barrel portion 24 of inner wall 46 to handle portion 22. Furthermore, the integral construction of handle portion 22 with barrel portion 24 through inner wall 46 allows for a desirable tactile sensation when striking a ball with bat 20 along with good performance and force transfer to the struck ball.

In some embodiments, the thickness of inner wall 46 of barrel portion 24 can be the same as the thickness of outer wall 50 of barrel portion 24. In FIG. 2, outer wall 50 is shown as formed with multiple discrete layers 50*a*, 50*b* that are bonded together. It should be appreciated that these discrete layers are merely representative in nature and that outer wall 50 can be formed from a single layer of multiple plies 94 or more than two discrete layers, as desired. Additionally, it should also be appreciated that the thickness of bond-inhibiting interface 54 is shown in the figures for illustration purposes only and that the thickness of bond-inhibiting interface 54 can vary from that shown based upon the desired construction of bat 20.

The location of damping member 40 on bat 20 can vary based upon the physical construction of bat 20 and the desired characteristics for bat 20. The vibrational bending modes of a bat can include a fundamental or first bending mode, a second bending mode, and a third bending mode. These differing modes can have vastly different frequencies and amplitudes. The bending modes can effect the location of the "sweet spot" of the bat. In some embodiments, damping member 40 is preferably located at the average anti-node of the first and second vibrational bending modes for the bat. The positioning of damping member 40 at the average anti-node can result in damping member 40 being located at a position wherein a non-damped vibration for the first and second modes would be at their greatest amplitude (i.e., the anti-node). The locating of damping member 40 to reduce the amplitude of the vibrations caused by the first and second modes can be balanced against the impact of damping member 40 on the "sweet spot" of bat 20. Further, it should be appreciated that the position of damping member 40 between inner and outer walls 46, 50 can alter the frequencies of the first and second vibrational bending modes versus that of a bat of a conventional construction without damping member 40.

Figure 12:
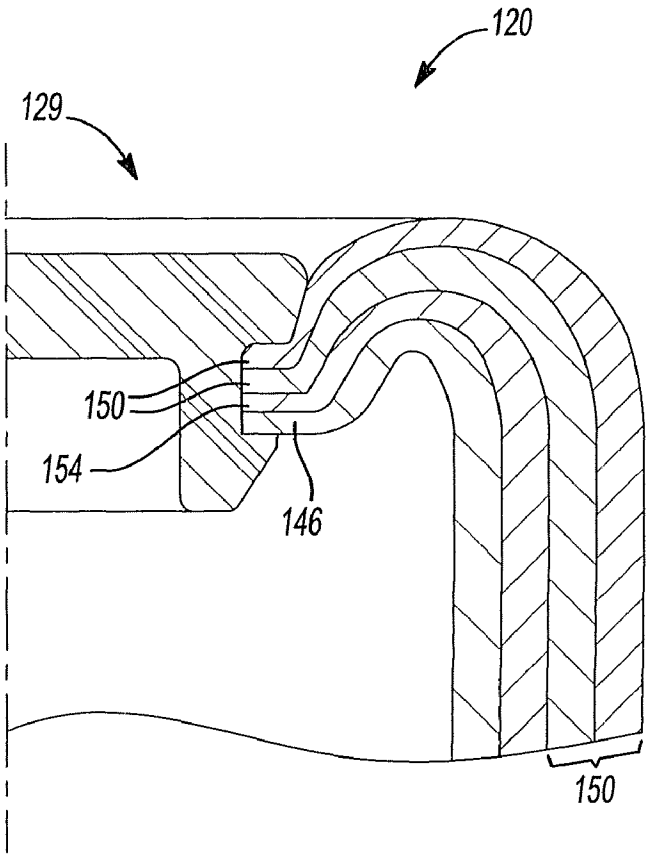
FIG. 12 is a fragmented cross-sectional view of an alternate construction for an end of the bat according to the present teachings.

Referring now to FIG. 12, the construction of an alternate bat 120 according to the present teachings is shown. Bat 120 is similar to bat 20 described above. As such, only the differences will be described herein. In bat 120, bond-inhibiting interface 154 extends all the way to end 129. As a result, outer wall 150 is not bonded to inner wall 146 at any location. The tapering of the tapering portion along with the compression molding process imparts interference fit-type mechanical arrangements that prevent outer wall 150 from separating from bat 120 during use. The entire separation of inner and outer walls 146, 150 from one another can advantageously allow for additional slip therebetween, thereby facilitating the transfer of stress through the walls while imparting a significant force to a ball hit by bat 120.

Thus, in some embodiments bat 120 can have an outer wall 150 that is entirely free from bonding with inner wall 146. Additionally, a damping member can be disposed between inner and outer walls 146, 150 in the tapering portion of bat 120.

Figure 13:
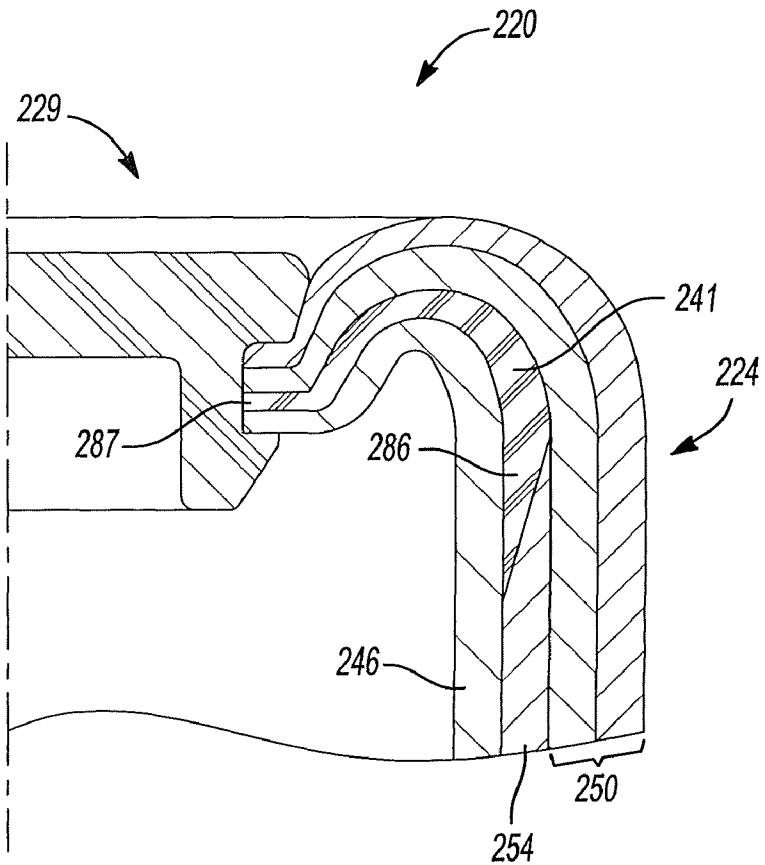
FIG. 13 is a fragmented cross-sectional view of another alternate construction for an end of the bat according to the present teachings.

Referring now to FIG. 13, the construction of yet another bat 220 according to the present teachings is shown. Bat 220 is similar to bat 20 discussed above. As such, only the differences between bat 220 and bat 20 will be described. In bat 220, a second damping member 241 is disposed between inner and outer walls 246, 250 at end 229. Second damping member 241 extends from end 229 partially along barrel portion 224. Second damping member 241 can include a tapering section 286 that tapers toward the handle portion of bat 220. The other end of second damping member 241 can curve radially inwardly to form a radial opening 287 that forms a part of end 229 and thereby maintains inner and outer walls 246, 250 separate from one another. Tapering section 286 extends either beneath, as shown, or above (not shown) bond-inhibiting interface 254. As such, bat 220 maintains outer wall 250 entirely isolated from inner wall 246 such that there is no bonding therebetween. As a result, additional damping of vibrations of bat 220 can be achieved while still maintaining desirable tactile sensations to a user of bat 220.

Thus, a bat according to the present teachings can utilize a damping member to dampen vibrations of the bat. Additionally, the damping member can serve to separate the outer wall from the inner wall, thereby reducing vibration transfer to the handle of the bat. The integral nature of the handle portion with the inner wall of the barrel provides a desirable tactile sensation when striking a ball with the bat.

It should be appreciated that while the bats according to the present teachings are shown and described with reference to specific examples, that such illustrations and descriptions are merely exemplary in nature and that variations can be employed without deviating from the spirit and scope of the present teachings. For example, while the bats are shown as having inner and outer walls, more than two walls can be employed. Furthermore, the location of the damping member can change from that shown. Additionally, the physical shape and dimensions of the damping members can also vary from that shown. Thus, the description and illustrations used in describing the present teachings are merely exemplary in nature and variations can be employed without deviating from the spirit and scope of the present teachings.

What is claimed is:

1. A bat comprising:

a handle portion adjacent a first end;

a barrel portion adjacent a second end, the barrel portion being a multi-wall construction and including an inner wall radially surrounded by an outer wall;

a tapering portion connecting the handle portion to the barrel portion; and a damping member damping vibration between the barrel portion and the handle portion, wherein the inner wall extends from the first end to the second end and forms the handle portion, the tapering portion and the barrel portion, the damping member is disposed on the inner wall, and the outer wall extends from the second end toward the first end and terminates on the damping member with the damping member separating the inner wall from a portion of the outer wall on the damping member, and the inner and outer walls are only bonded together adjacent the second end.

2. The bat of claim 1, wherein the damping member is on the tapering portion and the outer wall forms a part of the tapering portion.

3. The bat of claim 1, wherein the damping member includes a tapering section and a generally cylindrical section and the generally cylindrical section is disposed between the inner and outer walls.

4. The bat of claim 1, wherein the damping member has a hardness between about 20 to about 100 on a Shore 00 scale.

* * * * *